United States Patent [19]

Collins

[11] 4,408,434

[45] Oct. 11, 1983

[54] MULTI-STOREY BUILDING AND A PREFABRICATED PANEL FOR SUCH A BUILDING

[76] Inventor: Leonard D. Collins, 28 Wychelm Rd., Hornchurch, Essex, England

[21] Appl. No.: 223,061

[22] Filed: Jan. 7, 1981

[30] Foreign Application Priority Data

| | | | |
|---|---|---|---|
| Jun. 19, 1979 | [GB] | United Kingdom | 7921241 |
| Jun. 19, 1979 | [GB] | United Kingdom | 7921242 |
| Dec. 6, 1979 | [GB] | United Kingdom | 7942216 |

[51] Int. Cl.[3] ..... E04G 21/14

[52] U.S. Cl. ..... 52/745; 52/236.3; 52/236.6

[58] Field of Search ..... 52/745, 125, 236.6, 52/584, 126, 262, 263, 236.3

[56] References Cited

U.S. PATENT DOCUMENTS

| | | | |
|---|---|---|---|
| 3,372,519 | 3/1968 | Russell | 52/584 |
| 3,394,523 | 7/1968 | Sackett | 52/584 |
| 3,490,191 | 1/1970 | Ekblom | 52/236.6 |
| 3,568,380 | 3/1971 | Stucky | 52/745 |
| 3,760,540 | 9/1973 | Latoria et al. | 52/125 |
| 3,782,061 | 1/1974 | Minutoli et al. | 52/125 |
| 3,828,502 | 8/1974 | Carlsson | 52/125 X |
| 3,848,381 | 11/1974 | Bloxom | 52/236.6 |
| 3,940,903 | 3/1976 | Gunkel | 52/745 |
| 4,099,360 | 7/1978 | Outram | 52/745 |
| 4,219,978 | 9/1980 | Brown | 52/745 |

*Primary Examiner*—J. Karl Bell

*Attorney, Agent, or Firm*—Sughrue, Mion, Zinn, Macpeak and Seas

[57] ABSTRACT

A method of constructing a multi-storey building comprises the steps of laying a foundation ring beam for the external walls of the building, erecting a plurality of ground floor columns around the foundation ring beam, the ground floor columns being supported by the foundation ring beam and extending over substantially the height of the ground floor of the building, placing panels between the adjacent pairs of ground floor columns to form the external walls of the ground floor storey of the building, and constructing the higher storeys of the building successively one upon another. Each of the higher storeys is constructed by erecting a plurality of columns around the building, each of said columns being supported by a respective column of the storey immediately below and extending over substantially the height of that storey; supporting a floor on the upper edges of the wall panels of the storey immediately below, and by placing panels between the adjacent pairs of the columns to form the external walls of that storey. The uppermost storey of the building is covered by a roof which is supported on the upper edges of the wall panels of that storey. Each of the panels may comprise a core of reinforced concrete housed within a sheath made of non-corrosive material. The sheath constitutes a mold for casting the core and a permanent protective convering for the core when the concrete has been cured.

18 Claims, 9 Drawing Figures

MULTI-STOREY BUILDING AND A PREFABRICATED PANEL FOR SUCH A BUILDING

BACKGROUND OF THE INVENTION

This invention relates to a method of constructing a multi-storey building such as a block of flats, and is particularly concerned with the construction of blocks of flats having two, three, four or five storeys using prefabricated components. The invention also relates to a prefabricated panel for use in such a building.

One way of constructing such a block of flats is to erect the entire framework of the building structure, including columns and floor beams, and then to build the walls using either bricks or wall panels. Alternatively, the entire ground floor storey is built first, by erecting columns of the required height, followed by construction of the ground floor walls using bricks. The floor of the first storey is then built onto the top of the ground floor columns and walls, and the rest of the first floor storey is then built in the same way as the ground floor storey. Both of these methods have disadvantages in that they are time-consuming and in that they require in situ casting of columns and/or wall panels. Moreover, known prefabricated panels suffer from handling and erection problems.

SUMMARY OF THE INVENTION

The present invention provides a method of constructing a multi-storey building comprising the steps of laying a foundation for the external walls of the building, erecting a plurality of ground floor columns around the foundation, the ground floor columns being supported by the foundation and extending over substantially the height of the ground floor of the building, placing panels between the adjacent pairs of ground floor columns to form the external walls of the ground floor storey of the building, and constructing the higher storeys of the building successively one upon another, wherein each of the higher storeys is constructed by erecting a plurality of columns around the building, each of said columns being supported by a respective column of the storey immediately below and extending over substantially the height of that storey, by supporting a floor on the upper edges of the wall panels of the storey immediately below, and by placing panels between the adjacent pairs of said columns to form the external walls of that storey, the uppermost storey of the building being covered by a roof which is supported on the upper edges of the wall panels of that storey.

Advantageously, each column of each of the higher storeys is connected to the respective column of the storey immediately below by means of a tubular connector, the tubular connector being externally threaded and engaging with internally-threaded end portions of the two columns. Preferably, each tubular connector is screwed into the lower of its associated columns, an apertured joint plate is placed round the connector and overlying the upper edges of the two wall panels of the storey immediately below, and the upper of its associated columns is then screwed down onto the connector so as to force the joint plate down against said panel upper edges thereby clamping said panels firmly in position.

Preferably, the foundation is a foundation ring beam made by pouring concrete into a formwork positioned within a foundation excavation, the formwork containing reinforcement members, and the bases of the ground floor columns are housed in respective recesses in the foundation.

By arranging that the columns are equispaced and the storeys have the same height, all the panels can have the same basic shape. This gives obvious cost advantages.

Advantageously, each of the columns and each of the ground floor columns is made of tubular steel. In this case, the recesses in the foundation may be formed by drilling holes in the foundation after the concrete thereof has cured.

The method may further comprise the step of constructing a floor for the ground floor storey between the steps of forming the foundation and erecting the ground floor columns. Preferably, said floor is made by casting a concrete slab.

Advantageously, the floor of each higher storey is made by laying profiled floor sheets over the entire area of the building and by casting a slab of concrete over said floor sheets.

Similarly, the roof is made by laying profiled roof sheets over the entire area of the building and by casting a slab of concrete over said roof sheets. Preferably, a layer of rigid polyurethane foam is fixed to the top surface of the roof slab, and a layer of waterproof cement is laid on the top surface of said layer of rigid polyurethane foam.

The invention also provides a prefabricated panel for a building, the panel comprising a core of reinforced concrete housed within a sheath made of non-corrosive material, wherein the sheath constitutes a mould for casting the core and a permanent protective covering for the core when the concrete has been cured. Preferably, the sheath is made of aluminium.

Not only does this form of panel result in easy handling, but it also results in finished internal and external wall surfaces that are resistant to corrosion and wear. Moreover, these surfaces can be arranged to have an attractive finish, so that decoration need not be required.

Advantageously, the sheath is constituted by two side plates, two end plates and a base plate; and the side plates and the base plate have flanges which are rivetted to the end plates to form a rigid sheath. Preferably, a plurality of spacer plates are provided between the two side plates.

The external surface of one of the side plates may have a stucco stove enamelled baked-on finish and the external surface of the other side plate may have a plain mill finish. Also, a sheet of insulating material may be provided between the core and one of the side plates. Preferably, said sheet is made of rigid polyurethane form.

The invention also provides a method of making a prefabricated panel comprising the steps of constructing a sheath-like mould of non-corrosive material, and of casting a core of reinforced concrete within the mould, wherein the mould is left in place round the core after the concrete has been cured, thereby constituting a permanent protective sheath for the panel.

The invention further provides a method of making a plurality of prefabricated panels for a building, the method comprising the steps of constructing a plurality of sheath-like moulds of non-corrosive material on a frame, and of casting a core of reinforced concrete within each mould, wherein the moulds are left in place round the cores after the concrete has been cured, thereby constituting permanent protective sheaths for the building components.

Advantageously, the sheath-like moulds are positioned substantially vertically on the frame with their open ends uppermost, and the sheath-like moulds are secured to the frame.

The invention further provides a method of making and erecting prefabricated panels for a building, the method comprising the steps of making prefabricated panels as defined above, and further comprising the step of removing the panels from the frame using a crane.

BRIEF DESCRIPTION OF THE DRAWINGS

The invention will now be described in greater detail, by way of example, with reference to the accompanying drawings, FIGS. 1 to 7 of which illustrate schematically the various stages of building a two storey building, and FIG. 8 of which illustrates the construction of a prefabricated panel. In the drawings.

DESCRIPTION OF PREFERRED EMBODIMENTS

Figure 1A:
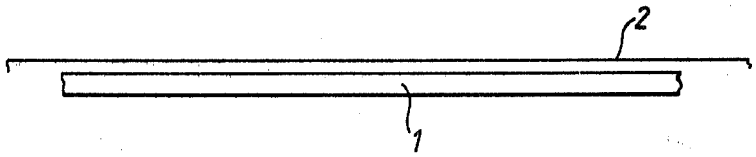
FIG. 1*a* is a side elevation of the foundation of part of one wall of the building.
Figure 1B:
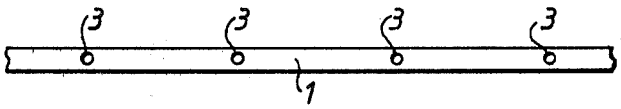
FIG. 1*b* is a plan view of the wall foundation shown in FIG. 1*a;*
Figure 2:
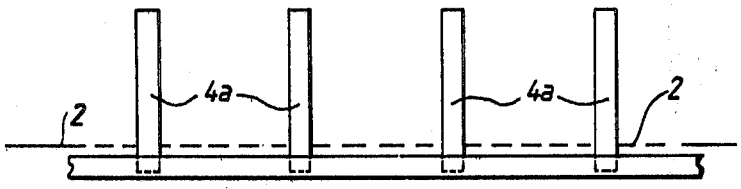
FIG. 2 is a side elevation showing ground floor storey columns positioned in the wall foundation of FIGS. 1*a* and 1*b;*

Referring to FIGS. 1 to 7, a two storey building is constructed using foundation ring beams, columns, wall panels and floor panels, FIGS. 1 to 7, showing the steps in the construction of part of one wall only for the building. It will be appreciated that the construction of the other walls of the building is carried out in a similar manner.

Prior to commencement of the construction of the building, the entire site is cleared by removing extraneous material. The site level is then reduced by approximately 150 millimeters, the removed material being carted away and dumped. The foundation excavation is then dug together with a drainage trench, the foundation excavation having a cross-section of approximately 750 milimeters by 750 millimeters, and the trench having a cross-section of approximately 400 millimeters by 500 millimeters. Re-usable formwork (not shown) is placed in the foundation excavation and the main foundation ring beam 1 (see FIGS. 1*a* and 1*b*) is constructed by pouring concrete into the formwork. The usual metal reinforcement rods are positioned within the formwork prior to the pouring in of the concrete. The foundation ring beam 1 is cast about 50 millimeters below the finished floor level 2. After three days, the formwork is removed for re-use, and the main foundation ring beam 1 is left to cure for a further fourteen days. While the main foundation ring beam 1 is curing, all the drainage pipes for the building and the backfill can be laid. Preparations can also be made for casting the floor slab.

After the main foundation ring beam 1 has cured, holes 3 are drilled in the ring beam, and the floor slab (not shown) is cast using reinforced concrete approximately 150 millimeters thick, the floor slab being cast so as to lie approximately 50 millimeters below the finished floor level. A floor screed (not shown) 50 millimeters thick can be added subsequently.

Columns 4*a* (see FIG. 2) are then positioned within the holes 3, these columns extending the full height of the ground floor storey. The columns 4*a* are tubular steel columns, and are erected using a crane.

Figure 3:
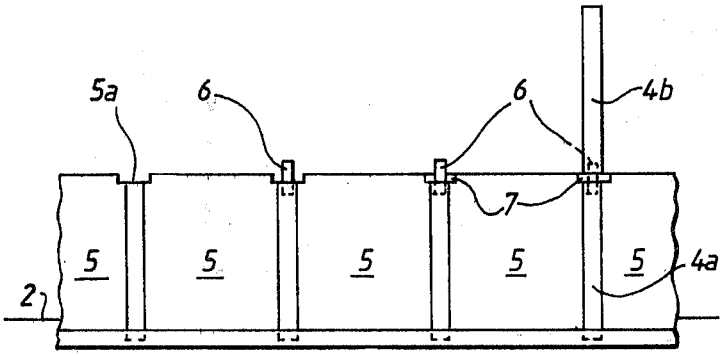
FIG. 3 is a side elevation showing ground floor storey wall panels positioned between the ground floor storey columns and the step of positioning the first floor storey columns.
Figure 4:
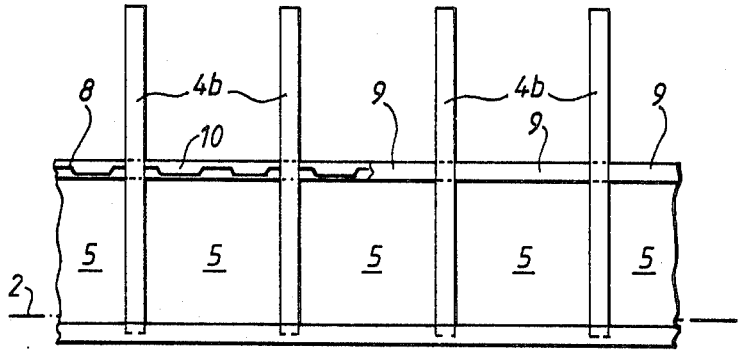
FIG. 4 is a side elevation showing the floor of the first floor storey positioned on the ground floor storey wall panels.
Figure 5:
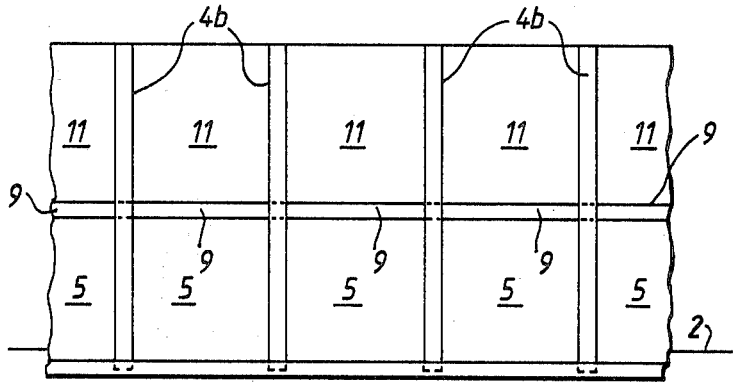
FIG. 5 is a side elevation showing first floor storey wall panels positioned between the first floor storey columns and resting on the floor of the first floor storey.
Figure 6:
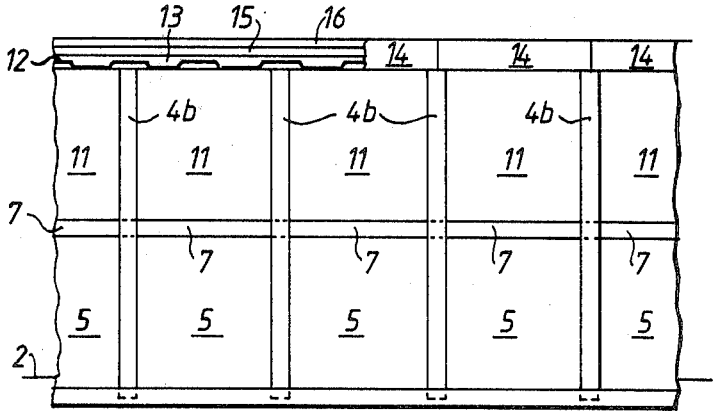
FIG. 6 is a side elevation showing the roof of the building positioned on the first floor storey wall panels.

After the columns 4*a* have been erected, the crane is used to position panels 5 between adjacent pairs of columns 4*a* right round the building (see FIG. 3). These panels 5 extend the entire height of the ground floor and so constitute the external ground floor walls of the building. The panels 5 may be standard prefabricated panels, or may be made, either on or off site, by the method described below with reference to FIG. 8. The vertical side edges of the panels 5 are formed with concave, longitudinal grooves which mate with the tubular columns 4*a*.

Figure 7:
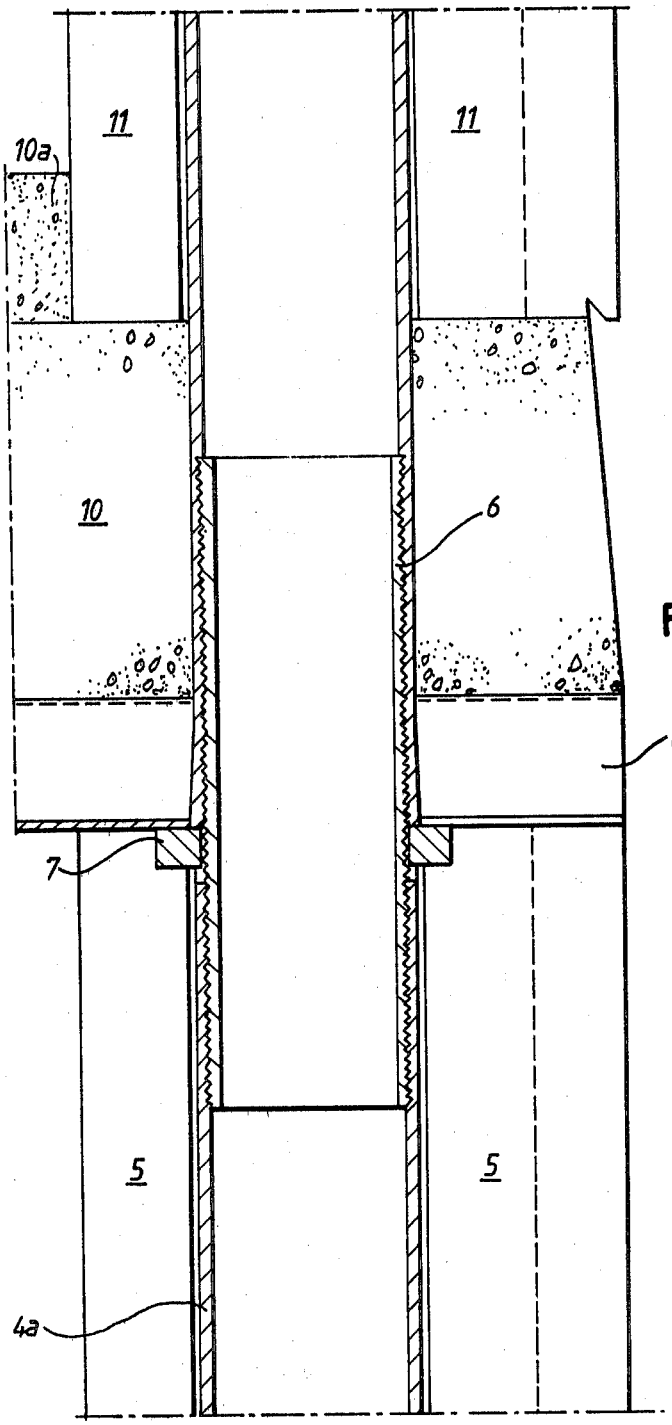
FIG. 7 is a cross-section, on an enlarged scale of a joint between a ground floor storey column and the corresponding first floor storey column.

FIG. 3 also shows the steps for fixing the panels 5 firmly in position. Thus, as can be seen at the extreme left-hand side column 4*a* of FIG. 3, each of the panels 5 is formed with an indent at its top corner, these indents forming a recess 5*a*. An externally-threaded, tubular connector 6 (see the next column 4*a* to the right) is screwed into the top of each column 4*a*, the columns having complementary internal screw threads. A respective steel joint plate 7 is then slotted over each tubular connector 6, and positioned within the corresponding recess 5*a* (see the next column 4*a to the right). Finally, columns 4b,* which extend the full height of the first floor storey, are screwed down onto the tubular connectors 6, the columns 4*b* having internal screw threads matching those of the connectors (see the extreme right-hand side column 4*a* of FIG. 3). The screwing-down of the columns 4*b* forces the steel joint plates 7 downwards to clamp the panels 5 firmly in position. FIG. 7 shows, in greater detail, the connection between one pair of aligned columns 4*a* and 4*b*. The lower end of each of the columns 4*b* is bell-ended so as to increase the area of contact with the corresponding plate 7.

After the external ground wall panels 5 have been clamped firmly into position, the internal ground floor walls (not shown) are constructed using, for example, concrete blocks.

When all the internal walls of the ground floor have been completed, deep trough-profiled floor sheets 8 (see the left-hand side of FIG. 4) are placed across the entire area of the building. These sheets 8 are pre-cut to size and are provided with cut-outs to accommodate the tubular inserts 6. The floor sheets 8 are secured by bolting to sockets (not shown) in the panels 5. The side edges of the first floor slab are covered by column-to-column side plates 9 (see the right-hand side of FIG. 4). These side plates 9 not only form the side edge of the floor slab, but also constitute a water trap, and house drains, electric conduits and reinforcing. A 100 millimeter thick layer of concrete is then poured over the floor sheets 8 and left to cure for three days. The concrete floor slab 10 so formed is subsequently covered with 50 millimeters of floor screeding 10*a* (see FIG. 7).

After the first floor slab 10 has cured, the crane is used to position further panels 11 (see FIG. 5) between adjacent pairs of columns 4*b* right round the building. The panels 11 extend the entire height of the first floor and so constitute the external first floor storey walls of the building. The panels 11 are fixed firmly in position by a method similar to that used for fixing the panels 5 of the ground floor storey. Thus, each column 4*b* is provided with an externally-threaded tubular connector (not shown but similar to the connectors 6) and with a steel joint plate (not shown but similar to the joint plates 7). Once in position, fixing is accomplished by screwing down internally-threaded spigots (not shown) onto the tubular connectors. This forces the joint plates down to clamp the panels firmly against the completed ground floor. As with the panels 5, the panels 11 have indents (not shown) at their top corners which define recesses for accommodating the joint plates. The panels 11 are identical to the panels 5 and are made, either on or off site, by the same method. The first floor storey internal walls are then constructed using, for example, concrete blocks. The recesses 5*a*, the connectors 6 and the joint plates 7 for connecting the columns 4*a* and 4*b* have not been shown in FIGS. 4 to 6 for the purpose of clarity.

When all the first floor storey internal walls have been put up, the roof of the building is constructed. As with the first floor, the roof is made up from deep trough-profiled sheets 12 (see the left-hand side of FIG. 6) and a 100 millimeter thick slab 13 of concrete. The sheets 12 extend across the entire area of the building and are secured, by bolting, to sockets in the panels 11. Edging angles 14 (see the right-hand side of FIG. 6) are placed and fixed in position along the top edge of the panels 11. These edging angles 14 form the edges of the roof, and also house electric conduits and reinforcing. The concrete is then poured over the sheets 12 and left to cure for three days. The top of the roof slab 13 is arranged to lie 90 millimeters below the top of the edging angles 14. After the concrete has cured, a layer 15 of rigid polyurethane foam 40 millimeters thick is adhered to the top surface of the slab 13, and this layer is covered with a 50 millimeters thick waterproof cement topping 16 (see the left-hand side of FIG. 6).

Obviously, the method described above could be applied to buildings having more than two floors. Indeed, the method is particularly useful for constituting blocks of flats having three, four or five storeys. In this case, the additional storeys are built in the same manner as the ground and first floor storeys, using panels identical to the panels 5 and 11 and sheets identical to the sheets 8 and 12. Obviously, where there are more than two storeys, the panels of all the storeys except the top storey are clamped in position by screwing down the columns of the storey immediately above.

Although not shown, it will be apparent that some of the panels 5 and 11 will be provided with doors and windows, the apertures for these being formed during the formation of the panels themselves.

Figure 8:
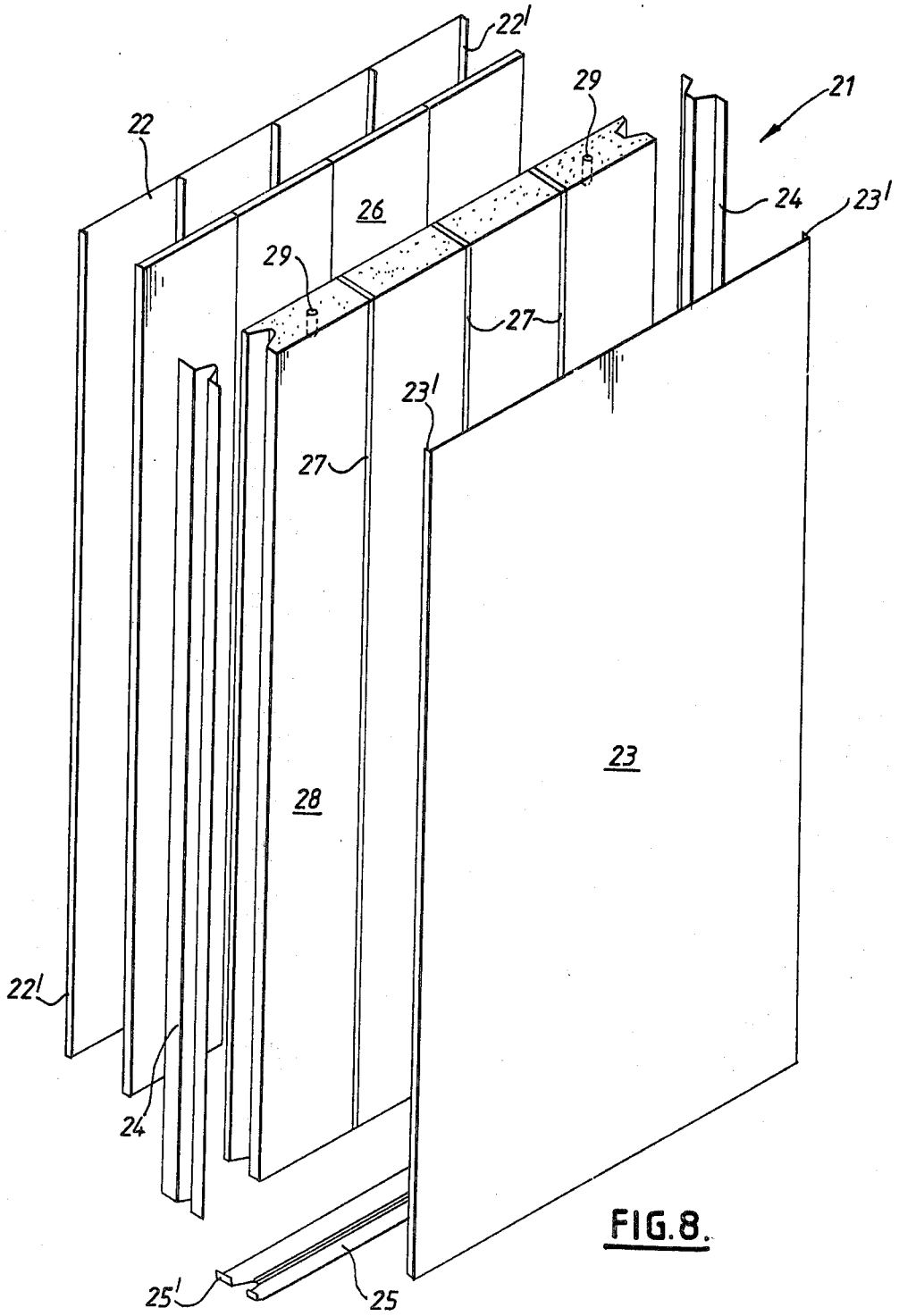
FIG. 8 is an exploded perspective view of a prefabricated panel constructed in accordance with the invention.

Referring now to FIG. 8, the form and constructional method of making the panels 5 and 11 will be described in detail. FIG. 8 shows a panel 21 having first and second mould side plates 22 and 23 respectively, two mould end plates 24 and a mould base plate 25. All the mould plates 22 to 25 are made of aluminium. The side plate 22, which is intended to form part of an external wall of a building, has a stucco enamelled baked-on finish in any one of twelve colours. Such a finish not only results in a pleasing appearance, but is also substantially vandal proof. The side plate 23, which is intended to form part of the internal wall of the building, has a plain mill finish which can be suitably decorated when the building is finished. The end plates 24 are shaped to mate with the columns 4*a* and 4*b* described above. The plates 22,23 and 25 are provided with flanges 22′, 23′ and 25′ respectively which are rivetted to the end plates 24 to form a mould whose dimensions are 150×1350×2900 millimeters.

A 25 millimeter thick sheet 26 of rigid polyurethane foam is positioned in the mould against the inside surface of the side plate 22. This sheet 26 acts, in use, as a heat-insulation layer. Three aluminium spacer plates 27 are positioned within the mould together with the usual steel reinforcement (not shown). The remainder of the mould is filled with concrete 28. The top edge of the concrete core is provided with a pair of threaded lifting inserts 29 by means of which the panel 21 can be lifted.

The panels 21 are made, in batches of twenty-four, on an assembly-transporting-erection (A.T.E.) frame (not shown). Each panel mould is made by first assembling the side plate 22, the end plates 24 and the spacer plates 27. The sheet 26 is then adhered to the inside face of the side plate 22, and the steel reinforcement is placed through the spacer plates 27. The side plate 23 and the base plate 25 are positioned, and the plates are then rivetted together to form the complete, rigid mould. The complete moulds are then placed vertically, open end upwards, in the A.T.E. frame and secured to prevent any hydraulic bulge. The moulds are then filled with concrete, a continuous vibration being carried out during the filling process. The panels are then left to cure for at least 21 days.

When the panels are required for erection, the A.T.E. frame (complete with the panels) is loaded onto a vehicle and transported to the building site. As and when required, the panels are released from the A.T.E. frame so that they can be lifted away (still in the vertical position) by means of a crane and the threaded lifting inserts 29. As indicated above, the panels 21 mate with the columns 4*a* and 4*b* so that these components can be put together to form a building having continuous, generally smooth internal and external walls.

It will be apparent that the panels described above have a number of advantages over known types of prefabricated panels. Thus, the permanent aluminium mould increases the strength of the panels, and so enables them to be transported, handled and erected more easily.

Although panel 21 described above is solid, it will be appreciated that panels incorporating doorways and window apertures could be made by the positioning of appropriate shuttering within the panel mould prior to the introduction of the reinforcement and concrete. It is also possible to clip-press joint the flanges 22′, 23′ and 25′ to the end plates 24. Moreover, the dimensions of the various parts are not critical. Thus, the insulation sheets 26 could be 30 miilimeters thick.

It will be apparent that the panel 21 described above could have its mould made of other metals than aluminium. It will also be appreciated that the method described above with reference to FIGS. 1 to 7 is not restricted to using panels of the type described with reference to FIG. 8. In particular, the method of FIGS. 1 to 7 could be used with panels similar to those of FIG. 8, but which have the protective mould removed after the concrete has been cured.

I claim:

1. A method of constructing a multi-storey building comprising the steps of laying a foundation for the external walls of the building, erecting a plurality of ground floor columns around the foundation, the ground floor columns being supported by the foundation and extending over substantially the height of the ground floor of the building, placing panels between the adjacent pairs of ground floor columns to form the external walls of the ground floor storey of the building, and constructing the higher storeys of the building successively one upon another, wherein each of the higher storeys is contructed by erecting a plurality of columns around the building, each of said columns being supported by a respective column of the storey immediately below and extending over substantially the height of that storey, by firmly clamping the wall panels of the storey immediately below in position, by then supporting a floor on the upper edges of the wall panels of the storey immediately below, and then by placing panels between the adjacent pairs of said columns to form the external walls of that storey, the uppermost storey of the building being covered by a roof which is supported on the upper edges of the wall panels of that storey.

2. A method according to claim 1, wherein each column of each of the higher storeys is connected to the respective column of the storey immediately below by means of a tubular connector, the tubular connector being externally threaded and engaging with internally-threaded end portions of the two columns.

3. A method according to claim 2, wherein each tubular connector is screwed into the lower of its associated columns, an apertured joint plate is placed round the connector and overlying the upper edges of the two wall panels of the storey immediately below, and the upper of its associated columns is then screwed down onto the connector so as to force the joint plate down against said panel upper edges thereby clamping said panel firmly in position.

4. A method according to claim 1, wherein the ground floor columns are equispaced around the foundation.

5. A method according to claim 1, wherein the foundation is a foundation ring beam made by pouring concrete into a formwork positioned within a foundation excavation, the formwork containing reinforcement members.

6. A method according to claim 1, wherein the bases of the ground floor columns are housed in respective recesses in the foundation.

7. A method according to claim 1, wherein all the wall panels have the same basic shape.

8. A method according to claim 1, wherein the panels are prefabricated and are placed in position using a crane.

9. A method according to claim 8, wherein each of the panels is made of concrete cast into aluminium moulds, and wherein the moulds are left in place after the concrete has been cured so forming integral parts of the panels.

10. A method according to claim 6, wherein each of the columns and each of the ground floor columns is made of tubular steel.

11. A method according to claim 10, wherein the recesses in the foundation are formed by drilling holes in the foundation after the concrete thereof has cured.

12. A method according to claim 1, further comprising the step of constructing a floor for the ground floor storey between the steps of forming the foundation and erecting the ground floor columns.

13. A method according to claim 12, wherein said floor is made by casting a concrete slab.

14. A method according to claim 1, wherein the floor of each higher storey is made by laying profiled floor sheets over the entire area of the building and by casting a slab of concrete over said floor sheets.

15. A method according to claim 1, wherein the roof is made by laying profiled roof sheets over the entire area of the building and by casting a slab of concrete over said roof sheets.

16. A method according to claim 15, wherein a layer of rigid polyurethane foam is fixed to the top surface of the roof slab, and a layer of waterproof cement is laid on the top surface of said layer of rigid polyurethane foam.

17. A method according to claim 1, further comprising the steps of constructing internal walls within each storey of the building.

18. A method according to claim 1, wherein the building has two, three, four or five storeys.

* * * * *